United States Patent [19]

Coakley et al.

[11] Patent Number: 4,576,198

[45] Date of Patent: Mar. 18, 1986

[54] SERVOVALVE WITH INTEGRATED FAILURE MONITORING

[75] Inventors: James L. Coakley, Fillmore, Calif.; Richard J. Haydt, deceased, late of Los Angeles, Calif., by Mette Haydt, legal representative

[73] Assignee: HR Textron Inc., Valencia, Calif.

[21] Appl. No.: 608,328

[22] Filed: May 8, 1984

[51] Int. Cl.[4] ..... F15B 13/043; F15B 20/00

[52] U.S. Cl. ..... 137/596; 91/438; 91/446; 91/448; 91/459; 137/625.64

[58] Field of Search ..... 91/363 A, 438, 446, 91/448, 459; 137/596, 625.64

[56] References Cited

U.S. PATENT DOCUMENTS

| | | | |
|---|---|---|---|
| 2,886,009 | 5/1959 | Myers | 91/363 A X |
| 2,995,014 | 8/1961 | Horky et al. | 91/438 X |
| 3,265,089 | 8/1966 | Nill | 137/625.64 X |
| 3,552,433 | 1/1971 | Mason | 137/596 X |
| 3,683,749 | 8/1972 | Bayles | 91/438 |
| 4,054,154 | 10/1977 | Mason | 137/625.64 X |

*Primary Examiner*—Gerald A. Michalsky

*Attorney, Agent, or Firm*—Nilsson, Robbins, Dalgarn, Berliner, Carson & Wurst

[57] ABSTRACT

An electrohydraulic servovalve which includes as an integral part thereof a monitor valve which senses the absence or lack of system pressure in the first or second stages of the valve and translates in the absence thereof to deactivate load control. The torque motor of the electrohydraulic servovalve is biased, electrically or magnetically, to provide a failure indication in the first stage of the valve in the absence of or excess of applied electrical signals to the torque motor.

8 Claims, 2 Drawing Figures

SERVOVALVE WITH INTEGRATED FAILURE MONITORING

BACKGROUND OF THE INVENTION

1. Field of the Invention

The field of art to which the invention pertains includes the field of fluid handling, electrohydraulic servovalves and failure detection thereof.

2. Description of the Prior Art

In the prior art it is common to use electrohydraulic servomechanisms to establish predetermined positions of control surfaces, engines and the like, responsive to electrical signals. It is desirous in such applications to detect failures of the servomechanisms to preclude catastrophic damage to the devices being controlled. The most objectionable types of failures occurring in a servosystem constitute the "hard-over" failure, for example, a constant saturated input signal pressure. When such failures occur the output member of the servomechanism moves to an extreme end of its travel. Obviously, such failures, if not immediately detected and corrective action taken, can lead to total loss of the overall system and failure of the mission in which the system is involved, particularly where aerospace vehicles are concerned. The most difficult to detect are usually the "soft" failures such as loss of input signal or loss of fluid pressure.

In the prior art various schemes have been developed to detect failures in the servomechanisms and responsive thereto to provide signals or actuate disenabling mechanisms. The best prior art known to applicants is contained in U.S. Pat. Nos. 2,886,009, 2,995,014, 3,265,089 and 3,552,433 and 4,054,154. Although such prior art systems operate appropriately under the applications and circumstances for which they were developed, they, for the most part, require conversion of position to pressure to electrical signals or similar such conversion, thereby requiring additional components as well as time to accomplish the detection signalling and/or disenabling.

SUMMARY OF THE INVENTION

The present invention provides a self-contained, self-monitoring, electrohydraulic servomechanism which can detect "hardover" or "soft" failures without long term lag. The apparatus disclosed and described herein is useful in a control system wherein hydraulic fluid is applied from a source to a load through ports controlled by a control spool valve which is positioned responsive to electrical signals applied to a torque motor. A monitor/switching spool is incorporated within the apparatus and is biased and disposed such that upon movement of the control valve spool responsive to failures of the type above referred to, the monitor/switching spool shuttles to disenable the control spool valve insofar as its effect upon a load connected thereto and in addition isolates the system pressure from the control spool valve.

In a more specific embodiment of the present invention a monitor spool valve is spring loaded against forces generated by the application of system pressure to one end thereof. The monitor spool is also adapted with appropriate passageways and ports to apply system pressure to the control spool when the system is operating properly but to isolate system pressure from the control spool and to interconnect the output ports of the control spool when the system is improperly operating. If the control spool moves to one of its limit positions responsive to input signal failure or pressure system failure, the forces generated by application of system pressure to the monitor spool are relieved allowing the spring bias to shuttle the monitor spool thereby shunting the output ports of the control spool valve and disconnecting system pressure from the control spool valve.

DETAILED DESCRIPTION

Figure 1:
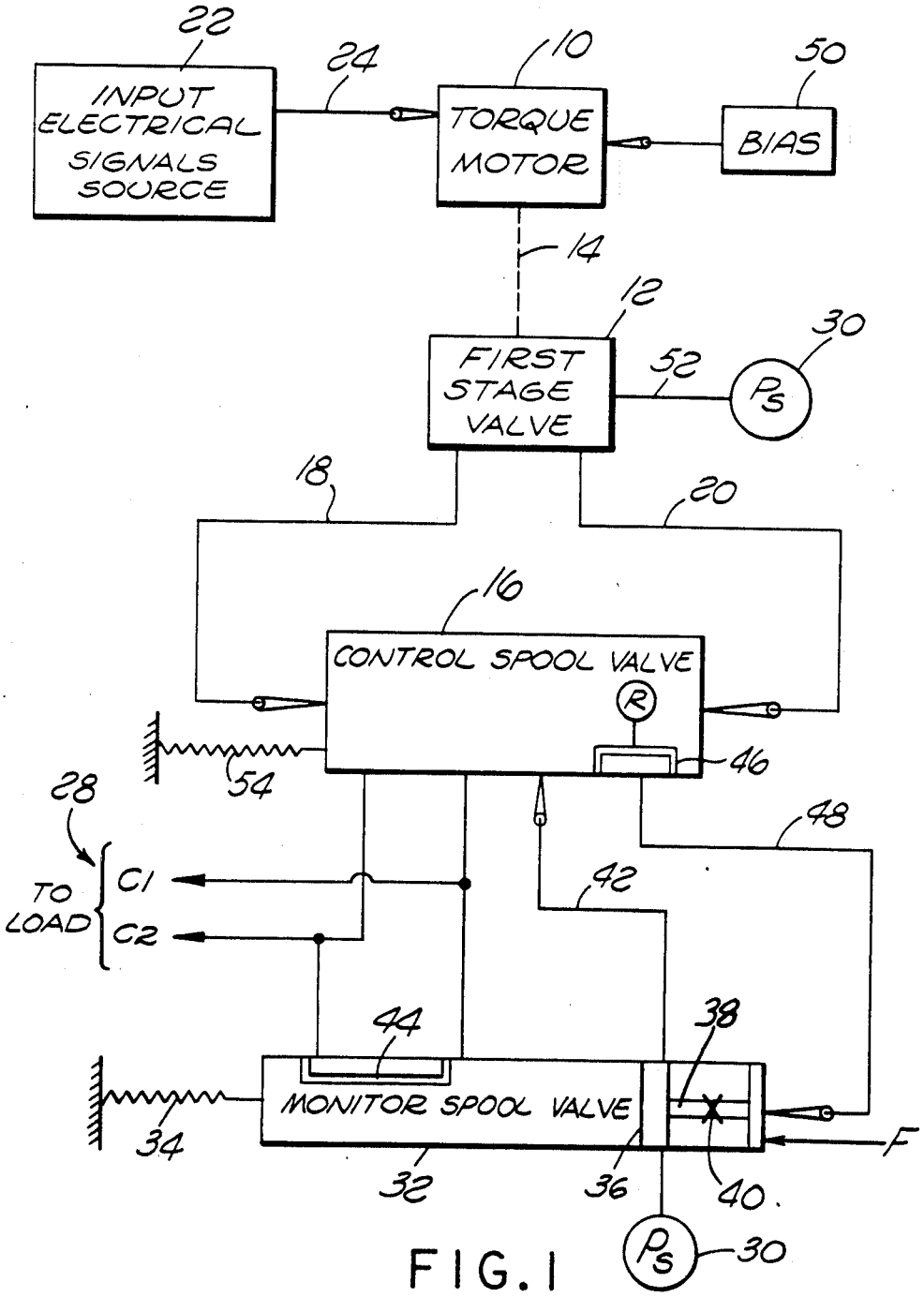
FIG. 1 is a schematic block diagram of a servovalve built in accordance with the present invention.

FIG. 1 illustrates in schematic block diagram form an electrohydraulic servovalve system which is adapted for applying hydraulic fluid from a pressurized source thereof to a load responsive to electrical input signals which are applied to the torque motor of the electrohydraulic valve. The hydraulic fluid under pressure flows through control ports to the load as a result of the positioning of a control spool valve which is hydraulically and mechanically connected to the torque motor as is well known in the prior art. The electrohydraulic servovalve includes a torque motor 10 which is connected mechanically and hydraulically to a first stage or pilot valve 12 as is indicated by the dashed line 14. A control spool valve 16 has pressure control signals applied to each end thereof from the first stage valve 12 through the conduits 18 and 20. The pressure signals applied to the control spool valve 16 are responsive to the electrical input signals applied from the source 22 thereof to the torque motor 10 over the leads or cable 24. The control spool valve 16 causes hydraulic fluid under pressure to flow to a load through the conduits shown at C1 and C2 and as indicated at 28. The pressurized fluid thus controlled is from a source 30 thereof. As will be recognized by those skilled in the art, the apparatus which has thus far been disclosed is a standard well known, state of the art, electrohydraulic servovalve used to position the load in response to the application of electrical signals applied to its torque motor.

In accordance with the principles of the present invention means is provided for causing the control spool valve 16 to move to one of its two limit positions in the event of a failure of the input electrical signals or the fluid pressure to or from the first stage valve. Movement of the control spool valve 16 to either of its limit positions in turn disables the flow of fluid through the control spool valve to the load and isolates the pressure source from the control spool valve. To accomplish disablement of the flow of fluid to the load and to isolate the pressure source from a control spool valve 16 there is provided an additional means in the form of a monitor spool valve 32 which is movable between first and second positions. A spring bias means 34 urges the monitor spool 32 in the first direction while the application of fluid pressure from the source 30 through passageways 36 and 38 as well as a restriction orifice 40 creates a force F against the opposite face of the monitor spool valve 32 causing it to move against the bias of the spring 34 to its second position. When in the second position (as illustrated in FIG. 1) the conduit 36 also provides the application of the fluid pressure source 30 to the control spool valve 16 as shown by the conduit 42. It should also be noted that the spool 32 is provided with an additional passageway 44 which is closed when the valve 32 is in the position as shown in FIG. 1.

It should also be noted that the control spool valve 16 has provided therein a passageway 46 which is connected to system return R as illustrated. When the control spool valve 16 is translated to either of its limit positions the passageway 46 is interconnected with the conduit 48 which in turn is connected to the passageway 38 in the monitor spool valve 32. Thus the pressure source 30, upon the translation of the valve 16 to a limit position, is connected to system return but through the restriction orifice 40. As a result, the force F drops below a predetermined value allowing the spring 34 to immediately shuttle the monitor spool valve 32 toward the right as illustrated in FIG. 1. In this position, the passageway 44 shunts the output ports of the control spool valve 16, C1, C2, together and at the same time, removes the passageway 36 from communication between the pressure source 30 and the conduit 42, thus removing system pressure from the control spool valve. It can thus be seen that upon the movement of the control spool valve 16 as above described the electrohydraulic servovalve system is immediately disabled.

The control spool valve 16 is caused to move to one of its two limit positions in the event there is a malfunction in the input electrical signals, that is, they fall below or above a predetermined amount, or alternatively, if system pressure which provides the control signal pressures through the conduits 18 and 20 fails.

Dealing first with the failure of the input electrical signals it will be noted that a bias shown at 50 is applied to the torque motor 10. The bias may take the form of an electrical signal which is separate from the input electrical signal source 22 to bias the torque motor in such a manner that a predetermined value of input electrical signal is required to position the torque motor and the first stage valve 12 at a null or zero command position. Alternatively, the bias 50 may be accomplished by adjusting the magnetic circuit in the torque motor 10 such that again a predetermined level of input signal is required to cause the torque motor and first stage valve to assume the null position.

In accordance with the preferred embodiment of the present invention the magnetic circuit within the torque motor 10 is adjusted such that hydraulic null is achieved in the first stage valve 12 when a command current of approximately 60% of rated current is applied from the input electrical signal source 22. Full flow from the cylinder port C1 would be accomplished at 100% rated current from the input electrical signal source 22 whereas full flow from the cylinder port C2 would occur at approximately 20% of rated current. It will be noted that all of the valve functions, that is, full flow from either of the cylinder ports or anything in between, is accomplished with a positive current. Obviously, the current could also be negative with the appropriate adjustments of the magnetic circuit. The important point to note is that all of the valve functions occur with input signal current of the same polarity applied to the torque motor. It will thus be seen that if the input electrical signals from the source 22 fall below 20% of rated current or exceed 100% of rated current, a "hard-over" condition exists and the control spool valve 16 will move to one of its limit positions depending upon the value of the current applied to the torque motor. In response to such movement, the monitor spool valve will shuttle as above described.

It should also be noted that the pressure source 30 is connected to the control spool valve 16 for porting of flow to the load through the ports C1 and C2 through a different conduit and passageways from the conduit 52 which is utilized to apply pressure to the first stage or pilot valve 12. In accordance with the preferred embodiment of the present invention the first stage valve 12 is a jet pipe valve having an ejector jet and a pair of receiver parts as is well known to those skilled in the art. In the event the jet pipe valve becomes clogged or for some other reason the pressure source 30 cannot be applied to the first stage valve 12, such as a failure in the conduit or the like, control signals will not appear in the conduits 18 and 20 applied to the control spool valve 16. Under these circumstances a spring 54 is utilized to continuously urge the control spool valve 16 toward the right as viewed in FIG. 1. Thus, in the event of a failure of control signals to be applied to the conduits 18 and 20, the spring 54 will shuttle the control spool valve 16 toward the right as viewed to its limit position with the attendant results as above described.

In the event there is a total loss of system pressure 30, such for example as a result of a loss of a pump, the failure of a conduit or the like such that no pressure can be applied to control the load, it will be noted that the force F applied to the end of the monitor spool valve 32 will reduce to zero. Upon such an occurrence the spring 34 shuttles the monitor spool valve 32 toward the right as shown in FIG. 1. In this position, the application of fluid pressure through the conduit 42 to the control spool valve 16 is eliminated and the control port C1, C2 are shunted through the passageway 44 in the monitor spool valve 32. Such will occur irrespective of the movement of the control spool valve 16. Thus this pressure loss will be detected and the monitor/switching spool will shuttle to protect the load if, for example, the system pressure which is applied solely to the control spool valve 16 should become inoperative for some reason.

Figure 2:
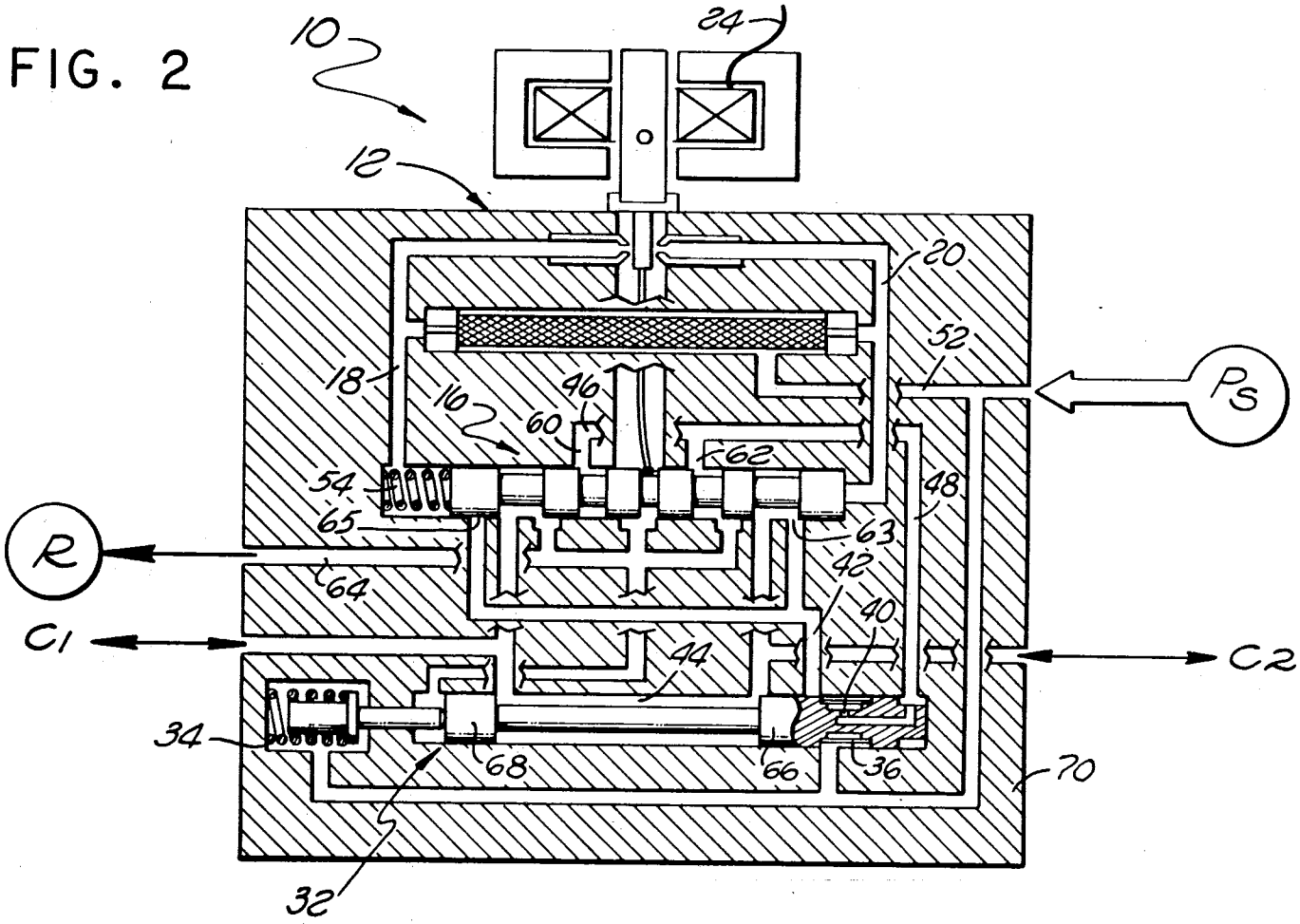
FIG. 2 is a schematic diagram in greater detail illustrating the valve as shown in block diagram form in FIG. 1.

Referring now to FIG. 2 there is shown more in detail a schematic representation of one form which the servovalve with integrated failure monitoring may take. The numbers utilized to designate the various components in FIG. 2 are the same as those used in conjunction with FIG. 1.

The schematic diagram of FIG. 1 as will be recognized by those skilled in the art is illustrated in the position when operable control signals and full pressure are being applied to the system. Alternatively, the structure as shown in FIG. 2 is illustrated with zero system pressure applied, thus causing the control spool valve 16 to translate to its limit position toward the right as is illustrated.

It will furthermore be recognized that the structure shown in FIG. 2 illustrates a nozzle flapper first stage valve which may also be utilized in accordance with the principles of the present invention, although, as above indicated, a jet pipe valve is preferred.

As can be seen, when the control spool valve 16 is in the position as illustrated in FIG. 2 the conduit 48 is connected through the ports 62 to system return by way of the conduit 64. When such is accomplished, system pressure Ps is connected through the restriction orifice 40 and the passageway 36 provided by the reduced diameter portion of the spool 32 to system return. At the same time, the land 66 on the spool valve 32 blocks the passage 42 from communication with system pressure, thereby precluding the application of system pressure to the control ports 63 and 65. It will also be noted that the lands 66 and 68 on the monitor/switching spool interconnect the ports C1 and C2 with the passageway 64 provided by the reduced diameter section of the spool between the land 66 and 68. Through this interconnection of the ports C1 and C2 or the shunting thereof, the control valve is disabled. Alternatively, if such is desired, the land 66 and 68 could be positioned in such a way as to block communication between the ports C1 and C2 and control valve 16. Such would also disable the utilization of the electrohydraulic servovalve from control of a load connected to the ports C1 and C2.

It will be recognized by those skilled in the art that the monitor/switching spool valve 32 is incorporated as an integral part of the electrohydraulic servovalve system within the same housing 70 as the other component parts of the system. It will thus be seen that through the utilization of such an integrated failure monitoring system little or no additional weight or space is required and by the interconnection with the pressure portions of the system, relatively short passageways and conduits are utilized thereby radically reducing the amount of time required for the recognition of a failure and response thereto.

What is claimed is:

1. In an electrohydraulic control valve system for applying hydraulic fluid from a pressurized source thereof to a load responsive to electrical signals applied to the torque motor of said electrohydraulic valve through first and second ports controlled by a control spool valve, a mechanism for detecting a system malfunction when said control spool valve is in either of first and second limit positions comprising:

a source of hydraulic fluid under pressure;

a return for said source;

failure detection spool valve means movable between first and second positions;

spring means biasing said failure detection spool valve means toward said first position;

means connecting said fluid source to a first end of said failure detection spool valve means to move said failure detection spool valve means to said second position against the force of said spring means; and means including said control spool valve for connecting return to said first end of said failure detection spool valve when said control spool valve is in one of its limit positions thereby permitting said spring means to move said failure detection spool valve means to said first position.

2. The malfunction detection mechanism as defined in claim 1 which further includes a housing, said failure detection and control spool valves being disposed within said housing.

3. The malfunction detecting mechanism as defined in claim 1 wherein said source of fluid under pressure is applied separately to the pilot stage of a two stage servovalve and said failure detection spool valve which controls pressure to said control spool valve.

4. The malfunction detecting mechanism as defined in claim 1 which further includes means for biasing said torque motor so that said control spool valve is caused to function properly only in response to electrical signals of the same polarity.

5. The malfunction detecting mechanism as defined in claim 4 wherein said biasing means includes magnetic flux within said torque motor offsetting said control valve in the absence of control signals thereto.

6. The malfunction detecting mechanism as defined in claim 1 wherein said failure detection spool valve defines means for disabling said first and second ports when said failure detection spool valve is in its first position.

7. The malfunction detecting mechanism as defined in claim 6 wherein said means for disabling includes passageway means interconnecting said ports.

8. In an electrohydraulic control valve system for applying hydraulic fluid from a pressurized source thereof to a load responsive to electrical signals applied to the torque motor of said electrohydraulic valve through first and second ports controlled by a control spool valve, said source including a return, an integrated hydromechanically operated mechanism for sensing failures and deactivating load control responsive thereto comprising:

failure detection means including valve means disposed to provide fluid under pressure from a source thereof to said control valve, means biasing said torque motor so that upon application of non-operative electrical input signals thereto said control valve moves to a limit position indicative of a failure; and means including said control valve for connecting said failure detection means to said return responsive to said control valve moving to said limit position thereby to deactivate load control.

* * * * *